US010244797B2

(12) United States Patent
Comeau et al.

(10) Patent No.: US 10,244,797 B2
(45) Date of Patent: Apr. 2, 2019

(54) SHIRT WITH FLIP-UP FRONT PANEL

(71) Applicants: Jerry Comeau, Toronto (CA); Mark Avery-Kenny, Toronto (CA)

(72) Inventors: Jerry Comeau, Toronto (CA); Mark Avery-Kenny, Toronto (CA)

(73) Assignee: LOGAN FLIP UP LIMITED, Milton (CA)

( * ) Notice: Subject to any disclaimer, the term of this patent is extended or adjusted under 35 U.S.C. 154(b) by 173 days.

(21) Appl. No.: 15/235,976

(22) Filed: Aug. 12, 2016

(65) Prior Publication Data

US 2017/0042253 A1 Feb. 16, 2017

Related U.S. Application Data

(60) Provisional application No. 62/205,427, filed on Aug. 14, 2015.

(51) Int. Cl.

| | |
|---|---|
| ***A41D 27/18*** | (2006.01) |
| ***A41B 1/18*** | (2006.01) |
| ***A41D 13/00*** | (2006.01) |
| *A41D 15/00* | (2006.01) |
| *A41G 7/00* | (2006.01) |
| *A41D 1/04* | (2006.01) |

(52) U.S. Cl.

CPC ..... *A41B 1/18* (2013.01); *A41D 13/0015* (2013.01); *A41D 1/04* (2013.01); *A41G 7/00* (2013.01)

(58) Field of Classification Search

CPC .... A41B 1/00; A41B 1/18; A41D 1/04; A41D 13/0015

USPC ..... 2/206, 77, 115

See application file for complete search history.

(56) References Cited

U.S. PATENT DOCUMENTS

| | | | | | |
|---|---|---|---|---|---|
| 1,113,977 | A | * | 10/1914 | Freedman | A41D 3/00 2/108 |
| 1,338,187 | A | * | 4/1920 | Mainthow | A41D 11/00 2/84 |
| 2,647,261 | A | * | 8/1953 | Rassner | A41D 1/04 2/115 |
| 2,851,690 | A | * | 9/1958 | Jennings | A45D 44/08 2/50 |
| 2,922,164 | A | * | 1/1960 | Liff | A41B 13/00 2/49.2 |
| 4,078,265 | A | * | 3/1978 | Condit | A41D 1/04 2/115 |
| 4,277,848 | A | * | 7/1981 | Boehland | A41D 1/04 2/115 |
| 4,296,498 | A | * | 10/1981 | Vinson | A41D 15/005 2/115 |
| 4,453,274 | A | * | 6/1984 | Allen | A41D 1/04 2/102 |
| 4,710,981 | A | * | 12/1987 | Sanchez | A41D 27/08 2/115 |
| 4,975,985 | A | * | 12/1990 | Stimpson | A41B 1/00 2/106 |

(Continued)

*Primary Examiner* — Robert H Muromoto, Jr.
(74) *Attorney, Agent, or Firm* — Ridout & Maybee LLP

(57) ABSTRACT

A shirt or garment to be worn by a person and having a flip-up panel that is connected to a front panel of the shirt or garment, wherein the flip-up panel is movable between a lowered position in which it substantially covers the front panel to a raised position in which a portion of the front panel previously covered by the front panel is exposed and the flip-up panel substantially covers a face of the person.

17 Claims, 3 Drawing Sheets

(56) References Cited

U.S. PATENT DOCUMENTS 4,991,233 A * 2/1991 Hall ..... A41D 27/08 2/115
4,999,848 A * 3/1991 Oney ..... A41D 1/04 2/115
5,088,116 A * 2/1992 Gould ..... A41D 3/06 2/115
5,361,523 A * 11/1994 Robinson ..... A41D 27/08 2/95
5,379,461 A * 1/1995 Wilmers ..... A41D 27/08 2/115
5,398,343 A * 3/1995 Kuracina ..... A41D 15/002 2/106
5,454,119 A * 10/1995 Thomm ..... A41B 13/10 2/106
5,640,715 A * 6/1997 Adams ..... A41B 13/10 2/105
5,930,836 A * 8/1999 Morris ..... A41B 13/10 2/49.1
6,067,660 A * 5/2000 Contini ..... A41D 27/08 2/115
6,175,960 B1 * 1/2001 Knittel ..... A41D 27/08 2/115
D438,365 S * 3/2001 Mattrasingh ..... D2/840
6,216,269 B1 * 4/2001 Smith ..... A41B 13/10 2/46
6,314,581 B1 * 11/2001 Bond ..... A41D 1/04 2/115
6,532,596 B1 * 3/2003 Fosmo ..... A41B 13/10 2/202
6,820,281 B2 * 11/2004 Mariland ..... A41D 27/20 2/115
7,441,281 B2 * 10/2008 Salem ..... A41D 1/04 2/115
D632,462 S * 2/2011 Hartman ..... D2/831
D632,871 S * 2/2011 Woodall ..... D2/717
8,087,094 B2 * 1/2012 Karasina ..... A41D 1/04 2/115
8,181,274 B1 * 5/2012 Prince ..... A41D 27/08 2/115
D668,431 S * 10/2012 MacGillivray ..... D2/717
D698,127 S * 1/2014 Cheatham ..... D2/847
9,015,863 B2 4/2015 Brown
2003/0182714 A1 * 10/2003 Mariland ..... A41D 13/0015 2/247
2004/0083529 A1 * 5/2004 Tate ..... A41D 13/0015 2/115
2006/0230491 A1 * 10/2006 Levy ..... A41D 1/04 2/77
2010/0192276 A1 * 8/2010 Anderson ..... A41D 1/04 2/115
2011/0099684 A1 * 5/2011 Kane ..... A41D 27/08 2/115
2011/0154555 A1 * 6/2011 Messika ..... A41D 1/00 2/115
2011/0231982 A1 * 9/2011 Echikson ..... A41B 1/00 2/115
2012/0180186 A1 * 7/2012 Goodman ..... A41D 1/00 2/69
2012/0284894 A1 * 11/2012 Brown ..... A41D 13/0015 2/69
2013/0160180 A1 6/2013 Carcich et al.
2014/0082816 A1 * 3/2014 Christopher ..... A41D 27/08 2/69
2015/0040283 A1 * 2/2015 Moore ..... A41B 1/10 2/69

* cited by examiner

SHIRT WITH FLIP-UP FRONT PANEL

RELATED APPLICATIONS

This application claims priority to and the benefit of U.S. Provisional Application Ser. No. 62/205,427 filed Aug. 14, 2015, incorporated by reference.

FIELD

This description relates to wearable garments and in particular to shirts.

BACKGROUND

T-shirt designs that have an image on a back surface of the front of the shirt are sometime used as novelty items. Such shirts may for example have a T-REX head or other image printed on an inside of the shirt front such that the wearer can flip up the front of the shirt to position the image in front of his or her face. With such shirts, once the front of the shirt is flipped up the user's stomach and chest region is exposed which may lead to embarrassment of one or both of the shirt wearer and observers, especially if the shirt wearer does not have an undershirt on. As a result, existing flip-up shirts are generally acceptable wear only for children. Furthermore, the shirt fronts generally obstruct the wearer's vision when flipped up, and can be awkward to maintain in a flipped up position.

SUMMARY

According to one example, this document discloses a garment to be worn by a person that includes front and back panels connected to each other to extend, when worn, respectively in front of and behind a torso of the person, the front and back panels defining an upper collar opening from which the head of the person can protrude. A flip-up panel is secured to the front panel for movement between a lowered position in which the flip-up panel covers at least a portion of the front panel to a raised position in which the flip up panel covers a face of the person.

According to another example, this document discloses a shirt to be worn by a person and having a flip-up panel that is connected to a front panel of the shirt, wherein the flip-up panel is movable between a lowered position in which it substantially covers the front panel to a raised position in which a portion of the front panel previously covered by the front panel is exposed and the flip-up panel substantially covers a face of the person.

According to another example, this document discloses to be worn by a person that includes a base garment comprising front and back panels connected to each other to extend, when worn, respectively in front of and behind a torso of the person, the front and back panels defining an upper collar opening from which the head of the person can protrude and arm openings from which the arm of a person can extend. A flip up front panel is secured to the base garment and has a flip up region movable between a lowered position in which the flip up region covers at least a portion of the front panel to a raised position in which the portion of the front panel is exposed and the flip up region covers a face of the person. The flip up region is formed from mesh that obscures from view the portion of the front panel covered thereby when in the lowered position and obscures from view the face of the person covered thereby when in the raised position while permitting the person to see through the mesh. An elastomeric tension band is secured to opposite side edges of the flip up front panel and configured to extend behind the back panel to secure the flip up front panel in the lowered position and in the raised position.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

Figure 1A:
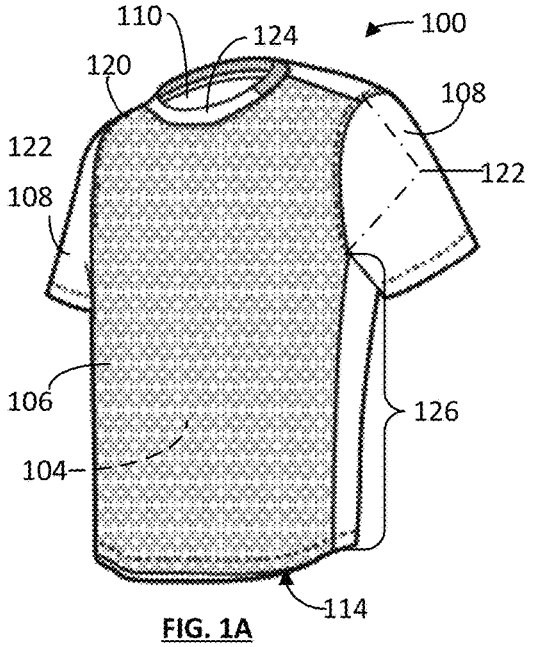
FIG. 1A is a drawing showing a perspective view of a front and left side of a shirt according to an example embodiment.
Figure 5A:
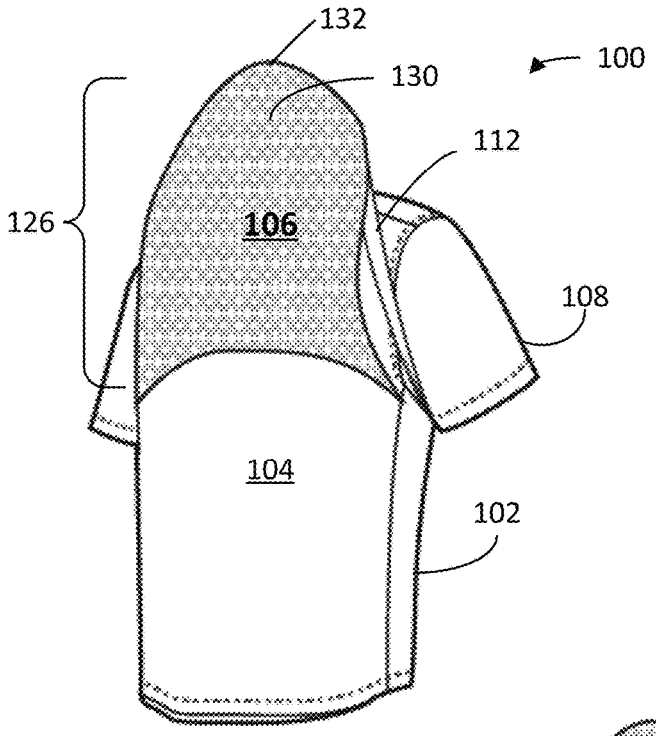
FIG. 5A is a drawing showing a perspective view of the front and right side of the shirt with an outer front panel fully flipped up, according to an example embodiment.
Figure 5B:
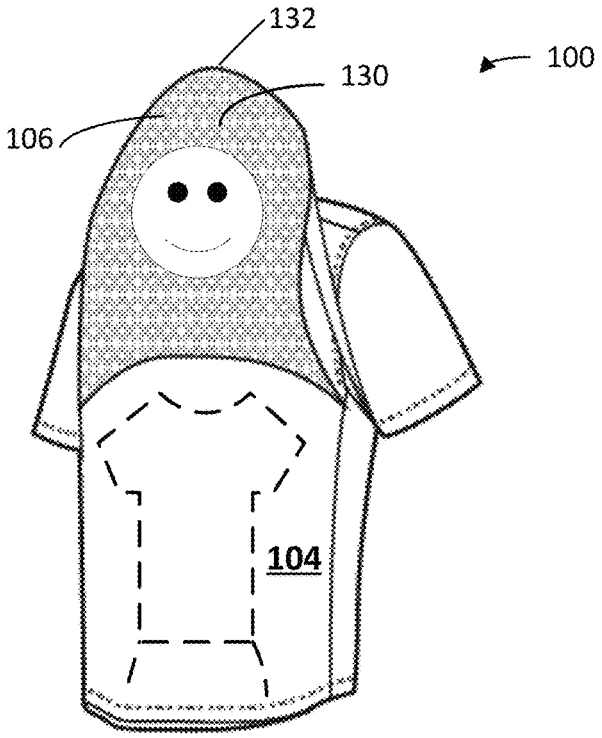
FIG. 5B is a further drawing showing a perspective view of the front and right side of the shirt with the outer front panel fully flipped up, according to an example embodiment.

As shown in FIGS. 1A to 5B, a wearable garment such as a shirt 100 is shown according to example embodiments. In the illustrated embodiment, the shirt 100 includes a base garment having many elements of a conventional t-shirt. For example, shirt 100 has short sleeves 108 that are joined to arm openings defined by shirt front and back panels 102, 104. Front and back panels 102, 104 are joined along left and right side seams and define an upper collar opening 110 for a wearer's head, and a lower torso opening 114. However, in addition to the elements of a conventional t-shirt, shirt 100 also includes a reversible flip-up front outer panel 106 that includes a lower flip up panel region 126 that can be pulled up from a lowered position as shown in FIGS. 1A and 1B to a raised position as shown in FIGS. 5A and 5B in which the panel region 126 of flip-up panel 106 is located over a wearer's head to simultaneously expose an image on the shirt front panel 104 and also expose, in front of the wearer's face, an image on a reverse or inner side of the flip-up panel 106.

In the illustrated embodiment, flip-up front outer panel 106 is a generally rectangular panel that is secured along a top edge 120 to an upper portion of the shirt 100. In an example embodiment, top edge 120 of flip-up panel 106 is coterminous with the top edge of the shirt front panel 104, such that the flip-up panel top edge 120, the top edge of the front panel 104 and the top edge of the shirt back panel 102 are joined at common seams to the right and left of collar opening 110. The central portion 124 of the top edge 120 of the flip-up panel 106 is secured to the portion of the top edge of the shirt front panel 104 around the front perimeter region of shirt collar opening 110. In the illustrated embodiment, upper right and left hand edge portions 122 of the flip-up panel 106 are connected to the shirt front panel 104 in the region of left and right sleeves 108. In the illustrated embodiment, upper right and left hand edge portions 122 are secured along the arm hole opening regions of shirt front panel 106. The remaining lower portion of flip-up panel 106 forms the flip-up panel region 126 and is not directly sewn or connected to the shirt front panel 104. In order to retain the flip-up panel 106 in its lowered position, an elastomeric tension band 112 is connected between the right and left side edges near a lower end of the flip-up panel region 126 to extend behind the shirt back panel 102.

As will be explained in greater detail below, tension band 112 also functions to keep the flip-up panel 106 in its raised, over the head, position. In various example embodiments, the elastomeric tension band 112 is between 2 inches (5 cm) to 6 inches (15 cm) in width and joined to side edges of the front panel 106 proximate the bottom of the flip-up panel 106. By way of non-limiting example, in some embodiments the lowest edge of tension band 112 is secured within 0 to 5 inches (13 cm) of the bottom of the flip-up panel 106.

In at least some example embodiments, flip-up panel 106 is formed from a mesh material that is of sufficient pitch and density to conceal the shirt front panel 104 when the region 126 of flip-up panel 106 is in its lowered position, but which allows the wearer to see through the mesh material without excessive visual obstruction when the flip-up region 126 of flip-up panel 106 is in its raised position in front of the wearer's face.

Figure 2A:
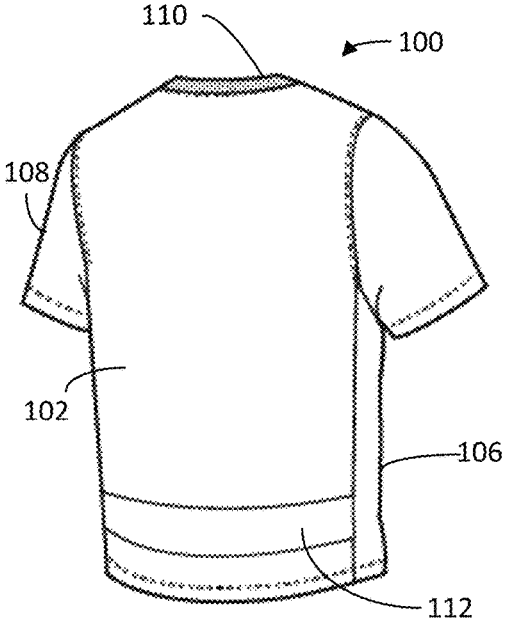
FIG. 2A is a drawing showing a perspective view of a back and right side of the shirt according to an example embodiment.
Figure 1B:
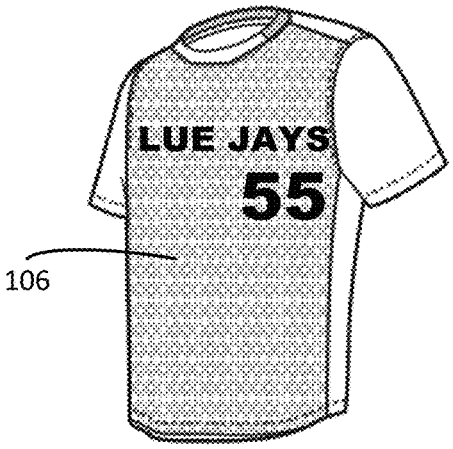
FIG. 1B is a further drawing showing a perspective view of the front and left side of the shirt according to an example embodiment.
Figure 2B:
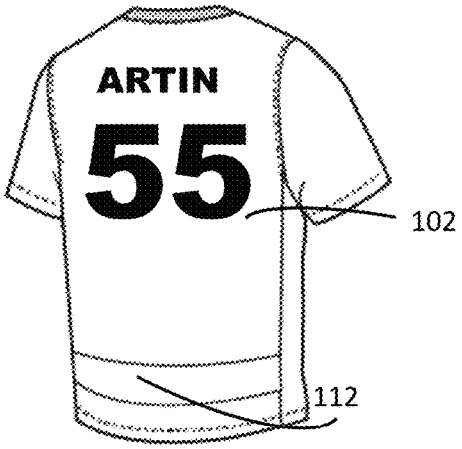
FIG. 2B is a further drawing showing a perspective view of the front and left side of the shirt according to an example embodiment.
Figure 3A:
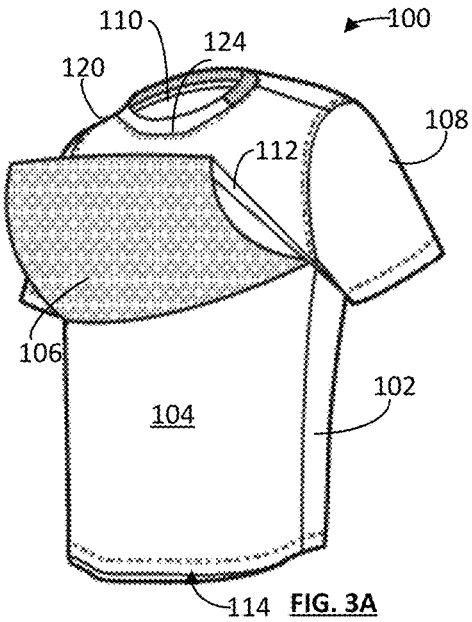
FIG. 3A is a drawing showing a perspective view of the front and right side of the shirt with an outer front panel partially flipped up, according to an example embodiment.
Figure 4A:
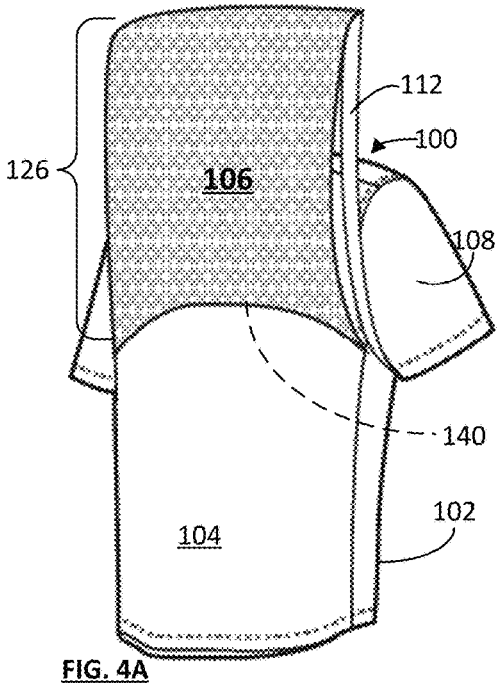
FIG. 4A is a drawing showing a perspective view of the front and right side of the shirt with an outer front panel further partially flipped up, according to an example embodiment.
Figure 3B:
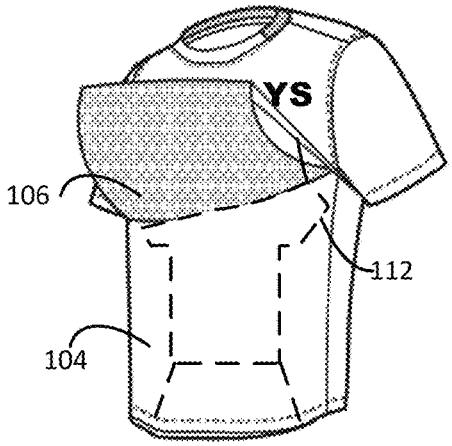
FIG. 3B is a further drawing showing a perspective view of the front and right side of the shirt with the outer front panel partially flipped up, according to an example embodiment.
Figure 4B:
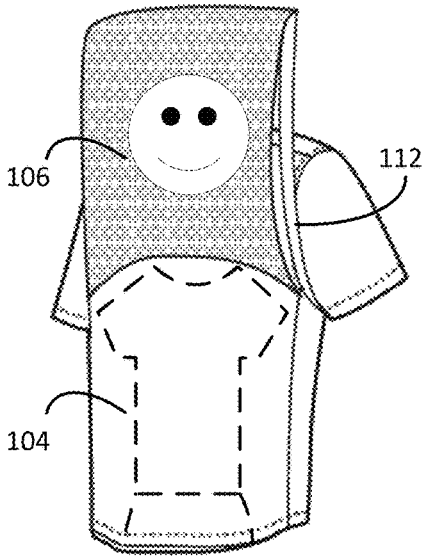
FIG. 4B is a further drawing showing a perspective view of the front and right side of the shirt with the outer front panel further partially flipped up, according to an example embodiment.

An example application of shirt 100 will now be described with reference to the Figures. FIGS. 1A and 1B show a front of the shirt 100 with the flip-up panel 106 in its lowered position, and FIGS. 2A and 2B show the back of the shirt 100 with flip-up panel 106 also in the lowered position. In the illustrated example, the shirt 100 appears to be a conventional sports team jersey when flip-up front 106 is in its lowered position. As can be seen in FIG. 1B, the outer front surface of the flip-up panel 106 has a graphic image or design on it—which may for example be the standard graphic image/brand used by a sports team (for example the "Lue Jays" in stylized script), along with the number of a player on the team (for example "55"). In the illustrated example, a player's name (for example "ARTIN") and number ("55") are displayed on the back of the shirt. The tension band 112, which secures the lower portion of flip-up panel 106 in place against shirt front panel 104, may be the same color as the shirt back panel 102, thereby disguising the presence of the tension band 112 that extends across the shirt back panel 102. In the lowered position, as shown in FIG. 1B, flip-up panel 106 obscures the shirt front panel 104.

FIGS. 3A to 4B show the shirt 100 as the flip-up panel 106 is being moved from its lowered position to its raised position. In the example embodiment, the wearer slides the tension band 112 up his or her back until it is located at a level that coincides generally with his or her arm pits. The wearer then grasps the lower portion of the flip-up panel 106 and flips it up so that a terminal portion 132 of the panel 106 covers and engages the top of the wearer's head, with a central region 130 of the region 126 of flip-up panel 106 covering the wearer's face.

In the illustrated embodiment, the front surface of the shirt front panel 104 has a graphic image or design applied to it that is different than the previously visible image that is on the front surface of the flip-up panel 106. For example in FIG. 5B, the image of a baseball catcher's torso with protective chest guard is visible on the front of shirt front panel 104. Furthermore, in the illustrated embodiment the back surface of the flip-up panel 106 has a different graphic image or design than was applied to the front surface of the flip-up panel 106. In the illustrated example, the graphic applied to the inner surface of the flip-up panel 106 is complementary to the image on the shirt front panel 104, namely an image of the face and head of the baseball catcher that wears the protective chest guard depicted on front panel 104. Thus, flipping up the flip-up panel 106 exposes juxtaposed graphic images that compliment each other. Additionally, in the illustrated example, the graphic (namely the player's face) exposed on the inner surface of flip-up panel 106 is complementary to the player's associated number ("55") and team name that is on the outer surface of flip-up panel 106 and the player's name and number that appears on the back of the back panel 102.

In example embodiments, elasticity of the material of flip up panel 106 and the tension band 112 collectively act to secure the flip-up panel 106 in its raised position in engagement with the wearers' head, enabling the wearer freedom of hand movement. The user can flip the flip-up panel 106 back down to its lowered position at will.

In the illustrated embodiment, the mesh material of flip-up panel 102 obscures the wearer's face from view such that the graphic image on the inner surface of flip-up panel 106 will be observed in place of the wearer's face, but at the same time the mesh material allows the wearer to see through the central portion 130 of the flip-up panel 106 that obscured the wearer's face. In some example embodiments, only the portion 130 or portions of the flip-up panel 106 that are intended to be located in front of the wearer's are made from mesh or see-through material, with the rest of the panel 106 being made from a denser material.

It will thus be appreciated that the shirt 100 can be configured to allow a sports fan to express adulation for or otherwise cheer on his or her favored player and team. The shirt 100 could also be used to implement a costume for Halloween or otherwise. In example embodiments, the shirt 100 could also be put to other applications—for example, flip-up panel 106 could be used to provide a protective barrier against sun, cold, rain, snow, wind, hail, debris, dust and other air-borne particles. Flip-up panel 106 could also be used to provide privacy or modesty to the wearer.

Many alternative configurations and modifications to shirt 100 are possible. For example, tension band 112 may be omitted in some embodiments. Although shown as a representation of a baseball jersey, shirt 100 could be any type of sports jersey such as a football jersey, basketball jersey, hockey jersey, soccer jersey, cricket jersey, and so on. The shape and location of the flip-up panel 106 can be varied, as well as its connection points to the remainder of the shirt 100. Sleeves 108 can be long sleeves. Crew neck collar opening 110 can be substituted with a turtleneck, mock turtleneck or wing collared opening. Shirt 100 can be a button up or zip up garment with shirt front 104 and flip up panel 106 each made up of two halves buttoned or zipped together. Shirt 100 could be a hoody. In some example embodiments the flip-up panel 106 could be applied to garments similar to shirts such as dresses, jackets and coats.

Accordingly, it will be appreciated that according to example embodiments this document describes a garment, such as shirt 100, to be worn by a person, that includes front and back panels 104, 102 connected to each other to extend, when worn, respectively in front of and behind a torso of the person, the front and back panels defining an upper collar opening 110 from which the head of the person can protrude. Flip-up panel 106 is secured to the front panel 104 for movement between a lowered position (FIGS. 1A-2B) in which the flip-up panel 106 covers at least a portion of the front panel 104 to a raised position (FIGS. 5A-5B) in which the flip-up panel 106 covers a face of the person.

In some examples, the flip-up panel 106 includes a region that is located in front of eyes of the person when in the raised position, permitting the person to see through the region. In some examples the see-through region may include openings. In some examples, the see-through region could be formed from mesh through which the person can see. In some examples, the flip up panel 106 is entirely or almost entirely formed from the mesh and the mesh substantially obscures the front panel 104 when in the lowered position and substantially obscures the person's face when in the raised position.

In the example shown, the flip-up panel 106 covers a top of the person's head in addition to the face of the person when in the raised position. Tension band 112 that is secured to opposite side edges of the flip-up panel 106 extends behind a lower region of the torso of the person when in the lowered position to secure the flip-up panel 106 in the lowered position. The tension band 112 is configured to extend under armpits of the person and behind a shoulder blade-level region of the torso when in the raised position to secure the flip-up panel 106 in the raised position.

In the illustrated embodiment, the flip-up panel 106 has an upper edge that is substantially coterminous with and secured to an upper edge of the front panel 104, and upper right and left side edges 122 that are secured to sleeve opening edges of the front panel 104. However, the top edge of flip up panel 106 could in some embodiments be secured to or terminate at a lower region of shirt front panel 104—for example, the flip up panel could include only lower region 126 and be secured along a generally horizontal seam that extends between the armpit regions of the shirt sleeve 108 such as illustrated by line 140 in FIG. 4A.

As described, the flip-up panel 106 has a first graphic design applied to an outer surface thereof that is only visible to a third person viewer when the flip-up panel 106 is in the lowered position, and a second graphic design applied to a reverse surface thereof that is only visible to the third person viewer when the flip-up panel is in the raised position. The front panel 104 has a front panel graphic design applied to it that is obscured from the third person viewer when the flip-up panel 106 is in the lowered position and visible to the third person viewer when the flip-up panel 106 is in the raised position.

While the garments disclosed and shown herein may comprise a specific number of elements/components, the garments could be modified to include additional or fewer of such elements/components. Certain adaptations and modifications of the described embodiments can be made. Therefore, the above discussed embodiments are considered to be illustrative and not restrictive.

What is claimed is:

1. A garment to be worn by a person, comprising:

a base garment comprising front and back panels connected to each other to extend, when worn, respectively in front of and behind a torso of the person, the front and back panels defining an upper collar opening from which the head of the person can protrude and arm openings from which the arms of a person can extend;

a flip up front panel secured to the base garment and having a flip up region movable between a lowered position in which the flip up region covers at least a portion of the front panel to a raised position in which the portion of the front panel is exposed and the flip up region covers a face of the person, the flip up panel having an upper edge portion that is secured to the front panel around a front perimeter of the upper collar opening; and the flip up region being formed from see-through mesh that obscures the portion of the front panel covered thereby when in the lowered position, and obscures the face of the person covered thereby when in the raised position while permitting the person to see through the mesh.

2. The garment of claim 1 wherein the base garment comprises a shirt.

3. A garment to be worn by a person, comprising:

front and back panels connected to each other to extend, when worn, respectively in front of and behind a torso of the person, the front and back panels defining an upper collar opening from which the head of the person can protrude;

a flip-up panel secured to the front panel for movement between a lowered position in which the flip-up panel covers at least a portion of the front panel to a raised position in which the flip up panel covers a face of the person, wherein the flip-up panel has an upper edge portion that is seamed along at least a portion of the upper collar opening, and wherein the flip up panel has right and left side edge portions that are seamed along sleeve opening edge portions of the front panel.

4. The garment of claim 3 wherein the flip-up panel includes a region that is located in front of eyes of the person when in the raised position, the region including openings permitting the person to see through the region.

5. The garment of claim 4 wherein at least the region is formed from mesh that provides the openings through which the person can see.

6. The garment of claim 5 wherein the mesh substantially obscures the front panel when in the lowered position and substantially obscures the person's face when in the raised position.

7. The garment of claim 3 wherein the flip-up panel covers a top of the person's head in addition to the face of the person when in the raised position.

8. The garment of claim 7 comprising a tension band that is secured to opposite side edges of the flip-up panel to extend behind a lower region of the torso of the person when in the lowered position to secure the flip-up panel in the lowered position.

9. The garment of claim 8 wherein the tension band is configured to extend under armpits of the person and behind a shoulder blade-level region of the torso when in the raised position to secure the flip-up panel in the raised position.

10. The garment of claim 3 wherein the flip-up panel upper edge is substantially coterminous with and secured to an upper edge of the front panel.

11. The garment of claim 3 wherein the flip-up panel has a first graphic design applied to an outer surface thereof that is only visible to a third person viewer when the flip-up panel is in the lowered position, and a second graphic design applied to a reverse surface thereof that is only visible to the third person viewer when the flip-up panel is in the raised position.

12. The garment of claim 11 wherein the front panel has a front panel graphic design applied to it that is obscured from the third person viewer when the flip-up panel is in the lowered position and visible to the third person viewer when the flip-up panel is in the raised position.

13. A shirt to be worn by a person and having a flip-up panel that is connected to a front panel of the shirt, wherein the flip-up panel is movable between a lowered position in which it substantially covers the front panel to a raised position in which a portion of the front panel previously covered by the front panel is exposed and the flip-up panel substantially covers a face of the person, wherein the flip-up panel has an upper edge portion that is seamed along at least a portion of an upper collar opening, upper right and left side edge portions that are seamed along sleeve opening edge portions of the front panel, and a lower portion that is not joined to the front panel.

14. The shirt of claim 13 wherein at least a portion of the flip-up panel is formed from see-through mesh that the person can see through when the flip-up panel is in the raised position.

15. The shirt of claim 14 comprising a tension band connected to a lower region of the flip-up panel for extending behind a torso of the person to secure the flip-up panel in the lowered position and to secure the flip-up panel in the raised position.

16. The shirt of claim 13 wherein the flip-up panel has a first graphic design applied to an outer surface thereof that is only visible to a third person viewer when the flip-up panel is in the lowered position, and a second graphic design applied to a reverse surface thereof that is only visible to the third person viewer when the flip-up panel is in the raised position.

17. The shirt of claim 16 wherein the front panel has a front panel graphic design applied to it that is obscured from the third person viewer when the flip-up panel is in the lowered position and visible to the third person viewer when the flip-up panel is in the raised position.

* * * * *